United States Patent [19]

Lieberman

[11] Patent Number: 4,726,470

[45] Date of Patent: Feb. 23, 1988

[54] STACKABLE CUP HOLDER

[76] Inventor: Paul Lieberman, 4102 Winterset, West Bloomfield, Mich. 48033

[21] Appl. No.: 606,455

[22] Filed: Jan. 23, 1987

[51] Int. Cl.[4] ..... B65D 21/02; A47G 19/23

[52] U.S. Cl. ..... 206/510; D7/70; 206/509; 220/85 H; 229/1.5 H; 248/145.6

[58] Field of Search ..... 206/503, 509, 510; 229/1.5 H; 220/85 H, 94 A; 248/145.3, 145.6; D7/8, 9, 70

[56] References Cited

U.S. PATENT DOCUMENTS

| | | | |
|---|---|---|---|
| 166,350 | 8/1975 | Dodge | 220/85 H |
| D. 203,942 | 3/1966 | Trombley | D7/70 |
| 1,389,594 | 9/1921 | Moore | 220/85 H |
| 2,122,628 | 7/1938 | Tracy | 220/85 H |
| 2,357,161 | 8/1944 | Barbieri | 229/1.5 H |
| 2,723,541 | 11/1955 | Treff | 248/145.3 |
| 3,596,795 | 8/1971 | D'Ercoll | 229/1.5 H |

FOREIGN PATENT DOCUMENTS

| | | | |
|---|---|---|---|
| 740619 | 8/1966 | Canada | 248/145.6 |

*Primary Examiner*—George E. Lowrance
*Attorney, Agent, or Firm*—Brooks & Kushman

[57] ABSTRACT

A stackable cup holder (10) for use with a disposable cup (12) is disclosed as including a cup holding body (14), and a handle (22) having an upper portion (24), and also a base (28) having a positioning space (30). The upper portion (24) of the handle (22) of another like stackable cup holder (10) includes a lip (32) which is received within the positioning space (30) to permit stacking of the stackable cup holders and to retain the disposable cup (12) in the body (14). Preferably, the body (14) is made from a ceramic material.

17 Claims, 3 Drawing Figures

STACKABLE CUP HOLDER

TECHNICAL FIELD

This invention relates to a stackable holder for disposable cups.

BACKGROUND ART

Cup holders have previously been utilized with disposable cups for containing hot or cold beverages. Some of the cup holders have been stackable. Many of these cup holders have tapered shapes that have occasion to stick together to adjoining cups in the stacked position, subsequently having to be forced apart to be accessible for use. Other cup holders have an inadequate disposable cup holding means whereby the disposable cups will release from the cup holder with tipping during use either at will or facilitated by the expansion or contraction of the disposable cup depending on the temperature of the fluid contained. The production of cup holders with these cup holding means has been limited because their structure requires relatively sophisticated production methods not generally suited for mass production of a ceramic cup.

Prior art references noted by a search conducted prior to filing this application are discussed below.

U.S. Pat. No. 2,803,375 to P. Meshberg for Nestable Vessels discloses a nestable pitcher having a handle with a free lower end to allow the pitcher to be partially inserted into another similar pitcher.

U.S. Pat. No. 2,858,041 to C. S. Robinson for Anti-Splash Vessel for Liquids discloses a cup with a baffle ring extending around the inner circumference of the side wall below the rim of the cup. The rim acts as a support for a like cup to be stacked thereon.

U.S. Pat. No. 2,885,134 to M. Cohen for Stackable Drinking Vessels and Stack Thereof discloses a drinking vessel having a flaired side wall and a tubular duct located at the side wall to operate as a straw.

U.S. Pat. No. 2,932,437 to I. L. Wilcox for Cup discloses a cup having an integral handle projecting from the rim of the cup. The handle is formed with depressions transverse of the handle whereby the cups are adapted to be stacked.

U.S. Pat. No. 3,151,798 to F. L. Meagher for Handle for Nestable Cups discloses a handle for attachment to the body of a disposable cup that permits the cups to be stacked within one another.

U.S. Pat. No. 3,596,795 to G. C. D'Ercoli for Nestable Cups and Holders discloses a thin walled, disposable cup of a truncated conical shape and a cup holder of a complementary shape for retaining the disposable cup.

U.S. Pat. No. 3,810,470 to L. J. Von Gunten for Nestable Pill-Administering Drinking Vessel discloses an open-ended pill administering drinking vessel. The drinking vessel has no handle and the bottom portion of the vessel is dished to make the vessel nestable with other identical vessels.

U.S. Pat. No. 3,880,281 to A. Taddei for Dental Products discloses a disposable cup having a rim with a radial projection for holding a toothbrush.

DISCLOSURE OF INVENTION

An object of the present invention is to provide a stackable cup holder for use with a disposable cup that is easily separable from like cup holders for use, is capable of retaining the disposable cup containing hot or cold liquids when the cup holder is tipped for drinking, and can be produced by relatively unsophisticated production methods suited for mass production of ceramic cups as well as by more sophisticated production methods suitable for mass production of plastic and metal cups.

In carrying out the above object and other objects of the invention, a stackable cup holder for use with a disposable cup constructed in accordance with the invention comprises a cup holding body having an open top end and a bottom end as well as having a side wall that extends from the bottom end to the top end. The cup holding body receives and supports the disposable cup. A handle on the body has an upper portion extending upwardly and outwardly above the top of the body and also having a gripping portion extending downwardly and outwardly from the upper portion. The handle is adapted to be grasped for holding the cup holder. A base of a flange shape extends downwardly and outwardly from the bottom end of the body integral with the body and has a positioning space therein for receiving the upper portion of the handle of another like stackable cup holder to permit stacking of the stackable cup holders.

In one embodiment of the invention the handle is rigid. This rigid handle can be integral with the body or can be detachable therefrom.

Preferably, the upper portion of the handle has a lip projecting radially inwardly above the top end to retain the disposable cup in the cup holding body. The handle forms an opening with the cup holding body to allow the upper portion and gripping portion to be grasped therearound. In the preferred embodiment, the gripping portion is arcuate.

The side wall of the stackable cup holder preferably tapers upwardly and outwardly from the bottom end to the top end of the cup holding body and forms a truncated conical shape. The cup holder is stackable so that the stack extends vertically.

The handle has angularly variable spacing with respect to the positioning space about the cup holding body. THe upper portion of the handle is insertable into the positioning space of the base of a like stackable cup holder. Preferably the upper portion of the handle and positioning space have complementary shapes. Most preferably, the complementary shapes of the upper portion of the handle and positioning space of the base are rectangular.

In a preferred construction, the base of the stackable cup holder is circular. Also, the base receives and retains the disposable cup.

The stackable cup holders are stackable such that each successive like cup holder is stacked with the base on the top end of the next preceding cup holder with the upper portion of the handle received within the positioning space of the base.

The above object and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
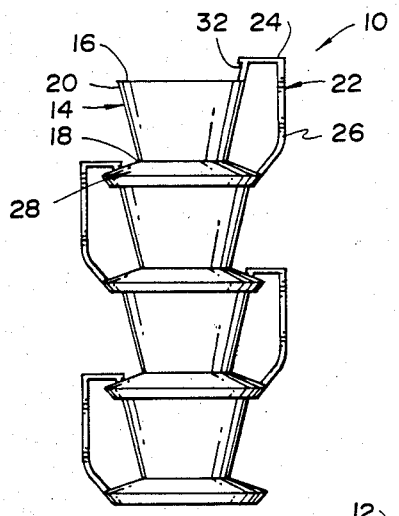
FIG. 1 is an elevational view of four stackable cup holders constructed in accordance with the present invention in stacked position.

With reference to FIG. 1 of the drawings, a stackable cup holder constructed in accordance with the present invention is generally indicated by 10 and is used to support a disposable cup 12 when in use and is readily stackable in the non-use position illustrated. As is more fully hereinafter described, the stackable cup holder 10 is readily stackable, easily separable from other like cup holders and capable of retaining disposable cups 12 containing hot or cold fluids.

Figure 2:
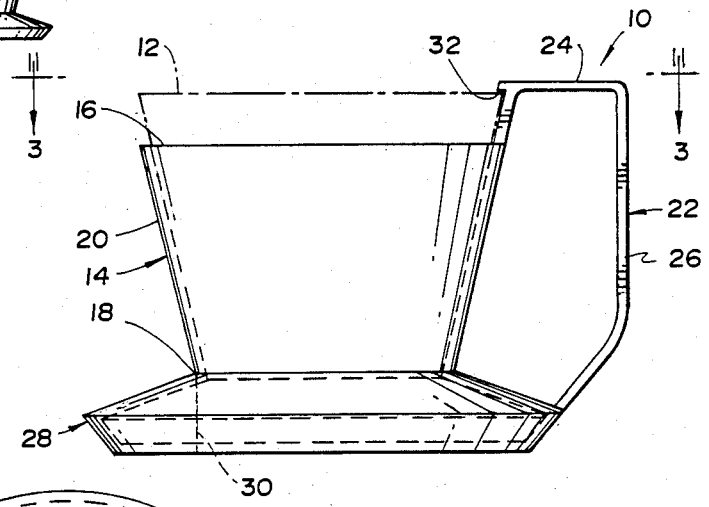
FIG. 2 is an elevational view of the stackable cup holder shown with a disposable cup, in phantom, retained therein.
Figure 3:
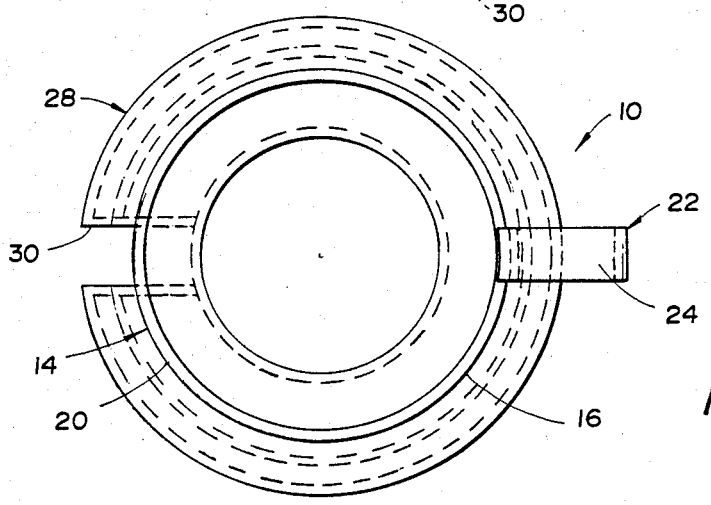
FIG. 3 is a plan view of the stackable cup holder showing the positioning of a handle and a positioning space.

As shown in FIGS. 2 and 3, the stackable cup holder comprises a cup holding body 14 having an open top end 16 and a bottom end 18 as well as having a side wall 20 that extends from the bottom end to the top end. The cup holding body 14 receives and supports the disposable cup 12. A handle 22 on the body 14 has an upper portion 24 extending upwardly and outwardly above the top 16 of the body. The handle 22 also has a gripping portion 26 extending downwardly and outwardly from the upper portion and adapted to be grasped for holding the cup holder 10. A base 28 of a flange shape extends downwardly and outwardly from the bottom end 18 of the body 14 integral with the body. The base 28 has a positioning space 30 therein for receiving the upper portion 24 of the handle 22 of another like stackable cup holder 10 to permit fixable stacking of the stackable cup holders in the non use position.

The handle 22 of the stackable cup holders 20 shown in FIGS. 1 through 3 is rigid although the handle can be made semi rigid if made from a plastic or metallic material. A slightly flexible handle may be preferred in order to allow the disposable cup 12 to be inserted more easily into the stackable cup holder 10. Handle 22 can be integral with the body 14 or may be detachable to allow for the use of a different material for the handle than that of the body.

Referring to FIG. 2, the upper portion of the handle 22 has a lip 32 projecting radially inwardly above the top end 16 to retain the disposable cup 12 in the body 14. The rigid handle 22 forms an opening with the cup holding body 14 to allow the upper portion 24 and gripping portion 26 to be grasped therearound. As shown, the gripping portion 26 is arcuate connecting the upper portion 24 of the handle 22 and the base 28 although the connection to the base is optional.

With further reference to FIG. 2, the side wall 20 tapers upwardly and outwardly from the bottom end 18 to the top end 16 forming a truncated conical shape. The stackable cup holder 10 shown is stackable so that when stacked the stack extends vertically.

As shown in FIG. 3, the rigid handle 22 is at 180° with respect to the positioning space 30 about the cup holding body 14 although the handle can be at any angle to the positioning space about the cup holding body. The upper portion 24 of the handle 22 is insertable into positioning space 30 of the base 28 of a like stackable cup holder. The upper portion 24 of the handle 22 and positioning space have complementary shapes so that the upper portion of a like stackable cup holder 10 can be received in the positioning space of another stackable cup holder. The complementary shapes of the upper portion 24 of the handle 22 and positioning space 30 of the base 28 are shown having a rectangular shape although other shapes may be used.

With further reference to FIG. 3, the stackable cup holder 10 is shown with a circular base 28. The base 28 also receives and retains the disposable cup 12, best seen in FIG. 2. Base 28 is shown having a closed bottom although a stackable cup holder 10 is invisioned having a base with an open center.

Referring to FIG. 1, stackable cup holders 10 are stackable such that each successive like cup holder is stacked with the base 28 on the top end 16 of the next preceding cup holder and with the upper portion 24 of the handle 22 received within the positioning space 30 of the base. In the arrangement shown, the handle 22 of each successive stackable cup holder 10 is spaced at 180° with respect to the preceding stackable cup holder's handle although other angles can be used. The stackable cup holders 10 in such a stack are easily separated as each successive cup holder is only placed thereon a preceding cup holder and no force is required to separate the cup holders.

The aforementioned stackable cup holders 10 can be made of any conventional material and cup holders of ceramic material can be produced by unsophisticated production methods.

While the best mode for carrying out the invention has been described in detail, those familiar with the art to which this invention relates will recognize alternative ways of practicing the invention as defined by the following claims.

What is claimed is:

1. A stackable cup holder for use with a disposable cup, the stackable cup holder comprising: a cup holding body having an open top end and a bottom end as well as having a side wall that extends from the bottom end to the top end such that the cup holding body receives and supports the disposable cup; a handle on the body and having an upper portion extending upwardly and outwardly above the top of the body and also having a gripping portion extending downwardly and outwardly from the upper portion and adapted to be grasped for holding the cup holder; and a base of a flange shape extending downwardly and outwardly from the bottom end of the body integral with the body and having a positioning space therein for receiving the upper portion of the handle of another like stackable cup holder to permit stacking of the stackable cup holders.

2. A stackable cup holder as in claim 1 wherein the upper portion of the handle has a lip projecting radially inwardly above at the top end to retain the cup in the body.

3. A stackable cup holder as in claim 2 wherein the handle is integral with the body.

4. A stackable cup holder as in claim 2 wherein the handle is rigid.

5. A stackable cup holder as in claim 2 wherein the handle forms an opening with the cup holding body to allow the upper portion and gripping portion to be grasped therearound.

6. A stackable holder as in claim 5 wherein the gripping portion is arcuate.

7. A stackable cup holder as in claim 2 wherein the side wall tapers upwardly and outwardly from the bottom end to the top end.

8. A stackable cup holder as in claim 7 wherein the cup holding body has a truncated conical shape.

9. A stackable cup holder as in claim 2 wherein the cup holder is stackable so that the stack extends vertically.

10. A stackable cup holder as in claim 9 wherein the handle has angularly variable positioning with respect to the positioning space about the cup holding body.

11. A stackable cup holder as in claim 2 wherein at least the cup holding body is made from ceramic.

12. A stackable cup holder as in claim 11 wherein the upper portion of the handle and positioning space have complementary shapes.

13. A stackable cup holder as in claim 12 wherein the complementary shapes of the upper portion of the handle and positioning space of the base are rectangular.

14. A stackable cup holder as in claim 2 wherein the base is circular.

15. A stackable cup holder as in claim 14 wherein the base also receives and retains the disposable cup.

16. A stack of stackable cup holders for use with disposable cups each stackable cup holder comprising a cup holding body of a truncated conical shape having an open top end and a bottom end as well as having a side wall that tapers upwardly and outwardly from the bottom end to the top end such that the cup holding body receives and supports the disposable cup; a handle on the body having an upper portion extending upwardly and outwardly above the top of the body and also having an arcuate gripping portion extending downwardly and outwardly from the upper portion and adapted to be grasped for holding the cup holder; and a base of a flange shape extending downwardly and outwardly from the bottom end of the body integral with the body and having a positioning space therein, each successive like cup holder being stacked with the base on the top end of the next preceding cup holder with the upper portion of the handle received within the positioning space of the base for stacking.

17. A stackable cup holder for use with a disposable cup, the stackable cup holder comprising: a cup holding body of a truncated conical shape having an open top end and a bottom end as well as having a side wall that tapers upwardly and outwardly from the bottom end to the top end such that the cup holding body receives and supports the disposable cup; a handle on the body having an upper portion of a rectangular shape extending upwardly and outwardly above the top of the body and also having an arcuate gripping portion extending downwardly and outwardly from the upper portion forming an opening with the cup holding body so adapted to allow the upper portion and gripping portion to be grasped therearound; the upper portion of the handle having a lip projecting radially inwardly above the top end to retain the cup in the body; and a hollow base of a flange shape extending downwardly and outwardly from the bottom end of the body integral with the body and also having a rectangular space, complementary to the shape of the upper portion of the handle, therein angularly spaced with respect to the upper portion of the handle about the cup holding body for receiving and supporting the upper portion of the handle of another like stackable cup holder to permit stacking of the stackable cup holders.

* * * * *

UNITED STATES PATENT AND TRADEMARK OFFICE

CERTIFICATE OF CORRECTION

PATENT NO. : 4,726,470

DATED : February 23, 1988

INVENTOR(S) : Paul Lieberman

It is certified that error appears in the above-identified patent and that said Letters Patent is hereby corrected as shown below: Title page:

Abstract Page, after "Appln. No.:" change "606,455" to --006,455--; and

Column 2, line 43, change "THe" to --The--.

Signed and Sealed this

Thirteenth Day of December, 1988

*Attest:*

DONALD J. QUIGG

*Attesting Officer*

*Commissioner of Patents and Trademarks*